US006109596A

United States Patent [19]

Garnier

[11] Patent Number: 6,109,596

[45] Date of Patent: Aug. 29, 2000

[54] LIFTING APPARATUS INCLUDING A SINGLE REEL AND MULTIPLE STRAP RUNS

[75] Inventor: Andre Garnier, Loudun, France

[73] Assignee: Ste d'Innovations Techniques (S.I.T.), Chatellerault, France

[21] Appl. No.: 09/234,639

[22] Filed: Jan. 21, 1999

[30] Foreign Application Priority Data

Jan. 21, 1998 [FR] France ..... 98.00594

[51] Int. Cl.[7] ..... B66D 1/36

[52] U.S. Cl. ..... 254/334; 254/337; 294/82.11

[58] Field of Search ..... 254/335, 336, 254/337, 338; 294/82.11, 74

[56] References Cited

U.S. PATENT DOCUMENTS

| | | | |
|---|---|---|---|
| 4,239,272 | 12/1980 | Corbett | 294/74 |
| 4,491,301 | 1/1985 | Pendola | 254/337 |
| 4,641,875 | 2/1987 | Speich | 294/82.11 |
| 5,927,780 | 7/1999 | Chandler | 294/82.11 |

FOREIGN PATENT DOCUMENTS

| | | |
|---|---|---|
| 0 082 046 | 6/1983 | European Pat. Off. . |
| 682 482 | 9/1939 | Germany . |
| 40 06 366 | 9/1991 | Germany . |

*Primary Examiner*—Katherine A. Matecki
*Attorney, Agent, or Firm*—Young & Thompson

[57] ABSTRACT

A load lifting device of the hoist type, comprises a flat strip 5 arranged to form two hoist runs on opposite sides of a connection member 6 for a load. The two runs of the strip 5 are simultaneously wound up on, or unrolled from, a single reel. A spacing roller 20 forms in the strip 5 a substantially horizontal upper run. This improves the stability of the load by spacing apart the upright runs 21, 22 of the hoist.

9 Claims, 3 Drawing Sheets

LIFTING APPARATUS INCLUDING A SINGLE REEL AND MULTIPLE STRAP RUNS

CROSS REFERENCE TO RELATED APPLICATION

This application corresponds to French application 98.00594 of Jan. 21, 1998, the disclosure of which is incorporated herein by reference.

FIELD OF THE INVENTION

The invention relates to lifting apparatus of the hoist type, which are used for handling various loads and are adapted to be mounted on portable structures such as bridges, booms, pylons, rail, jibs, gantries, masts and other suspension devices.

The invention is particularly applicable to mechanical hoists comprising an attachment device carried by pulleys on a flexible traction means, generally a cable adapted to be wound on the headstock of a motorized winch. When winding the cable, the lengths of the runs is identically shortened, such that the suspension system of the attachment device rolling on the cable remains practically immovable relative to the vertical and rises along this vertical. This type of lifting apparatus is well known and is not described in greater detail.

BACKGROUND OF THE INVENTION

Several drawbacks have been encountered in use when delicate or dangerous loads must be handled with great precision, particularly when it is prohibited to have a human being near the load, to aid in guiding the load in the course of handling.

There is primarily noted a tendency toward twisting of the runs of the traction cable, which twisting gives rise to rotation of the load itself, this rotation being unable to be controlled by the rotatable mounting of the attachment means on its support. Moreover, because the attachment means is free to move along the cable, there is noted a tendency of the load to swing and to slacken along the cable during lifting operations.

The document DE 682 482 discloses a lifting block mounted together with an electric motor drive. The flexible traction means is constituted by metallic strips of small thickness rolled spirally on at least one pair of spaced apart rollers, such that the two strips are simultaneously rolled or unrolled by an identical amount during operations of lifting a load. The use of a strip as enrollable traction means avoids any substantial twisting of the strip, whilst permitting raising the load along a vertical axis.

However, in this known device, the simultaneous rotation in opposite directions of the rollers of at least one pair of rollers requires the use of a high power electric motor coupled to a gear train adapted to drive the two mentioned rollers simultaneously in rotation.

The document EP 0 082 046 discloses an improved hoist with a flexible flat connection constituted by a textile strap or a flat metallic braid. This hoist is generally satisfactory, but has the drawback of being of complicated construction, costly production and difficult maintenance. This hoist is accordingly difficult to use in an environment in which a human cannot be present.

SUMMARY OF THE INVENTION

The invention has for its object to overcome these drawbacks, by providing a lifting apparatus in which the phenomena of twisting and slack have been minimized, or even overcome, and in which the replacement of the different elements can be carried out in a simple, rapid and economical matter, if desired by remote control.

The invention has for its object a lifting apparatus of the hoist type, comprising a flat strip forming two hoist runs, the two hoist runs being adapted to be unrolled and rolled up together on a single reel, by rolling up and unrolling simultaneously by an identical amount during the lifting operation of the load, characterized in that the strip passes over a spacing roller which forms in the strip a substantially horizontal upper run, so as to improve the stability of the load by the spacing thus imparted to the two rising runs of the hoist.

According to other characteristics of the invention:

- the flat strip is constituted by a strap of braided polyamide,
- the attachment member is mounted freely on the strip,
- the attachment member is mounted fixedly on the strip, or alternatively the attachment member is fixed to the lower ends of each run of the strip,
- a gear train can be disposed between the motor gear and the drive gear of the single reel.
- the strip can comprise an auxiliary strip forming a safety loop enclosing an attachment member mounted on the strip,
- the strip can pass over a supplemental spacing roller, so as to increase the stability of lifting; in this case, said supplemental spacing roller and the first spacing roller are mounted substantially at the same height and substantially symmetrically relative to the vertical plane of lifting of the load; and said supplemental spacing roller preferably forms in the strip a substantially vertical run winding up on a single reel.

BRIEF DESCRIPTION OF THE DRAWINGS

The invention will be better understood from the description which follows, giving by way of non-limiting example, with reference to the accompanying drawings, in which.

DESCRIPTION OF THE PREFERRED EMBODIMENTS

According to the two embodiments of the invention, the lifting apparatus is adapted to be used on any type of support, for example a bridge, or several suspended rails, a jib, one or several masts, or like supports. The lifting apparatus according to the invention is made modular to render easily interchangeable the various constituent elements and to facilitate all assembly and maintenance operations.

Figure 1:
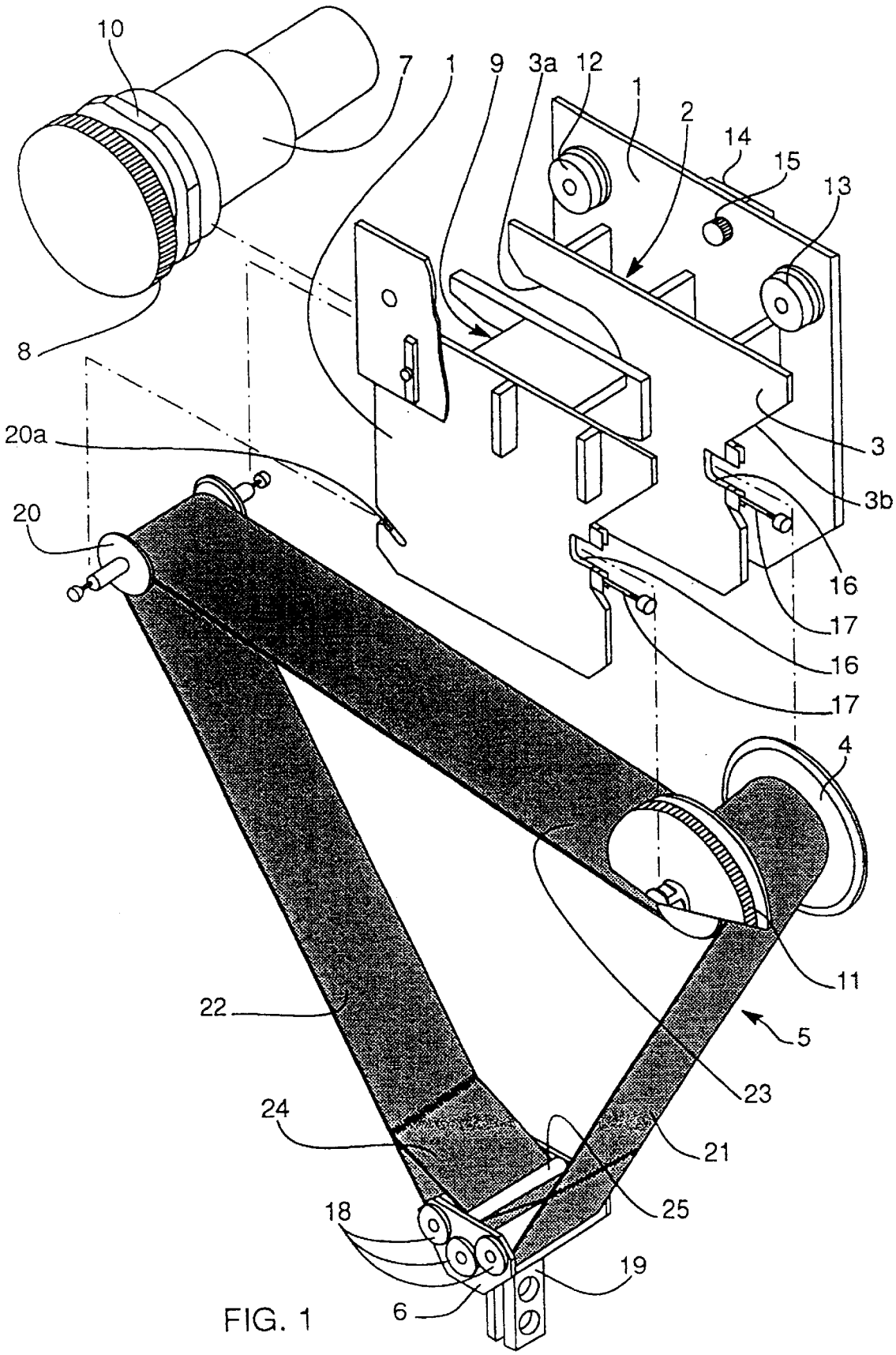
FIG. 1 shows schematically an exploded perspective view of a first embodiment of a lifting apparatus according to the invention.

With reference to FIG. 1, the lifting apparatus according to the invention comprises two plates 1 interconnected to form a frame 2 with cross-connectors comprising plates transverse to the plates 1 and parallel to the plates 1.

The frame 2 comprises an intermediate plate 3 with a cutout 3*a* and a recess 3*b* located opposite the cutout 3*a*.

The frame 2 is adapted for mounting a reel 4 for rolling up a strip 5 supporting an attachment member 6 to attach a connecting member for a load (not shown) of the hook, jaw, electromagnet type, or the like. The frame 2 is also adapted on the side of the cutout 3*a* for the mounting of a drive motor 7 whose output shaft carries an externally toothed gear 8 which is adapted to be mounted within a space 9 and be secured to the frame because of the securement of the member 10 secured to the frame 2.

In the mounted position, the gear 8 engages with a gear 11 of the windup reel 4, shown fragmentarily. The frame 2 can be a motionless frame suspended from a fixed position or it can constitute a carriage displaceable along a beam or support (not shown). In this case, the frame or carriage 2 preferably comprises rollers 12 and 13 for rolling on the flange of a beam or a support (not shown). The movement of the carriage 2 is ensured by the motor 14 mounted on a plate 1 on the side opposite the rollers 12 and 13. The motor 14 drives a drive roller 15 adapted to engage with a rack mounted on the flange of the beam or the support of the lifting apparatus, so as to move the lifting apparatus along the rack and along the support (not shown).

The recess 3*b* provided and on an intermediate plate 3 is prolonged at 16 to comprise a cradle 16 for reception of opposite axles of the reel 4. After mounting the axles of the reel 4 in the recesses 16 forming a cradle, the locking members 17 forming a lever ensure the blocking in position of the reel 4. Conversely, the locking members 17 permit dismounting the reel 4 to remove it from the frame 2 and carrying out maintenance operations or replacement of the strip 5.

The attachment member 6 is constituted by a mounting of a width substantially equal to or slightly greater than that of the strip 5. The attachment member 6 comprises three rollers 18. The strip 5 may pass around the three rollers 18. This modification would have the drawback of the attachment member 6 falling in case of breaking of the strip 5 at the level of the passage of the rollers 18.

At its lower portion, the attachment member 6 is provided with a support 19 permitting the mounting of a connection device for a predetermined load.

The strip 5 can be constituted of any suitable metallic or synthetic material, in sheets, mesh or weave. The strip 5 must have the two following properties: it must be adapted to be rolled up and to have high resistance to elongation, so as to ensure the simultaneous shortening or lengthening of the two runs of the strip during winding up or unwinding.

There is preferably used a strip 5 made of a strap of braided polyamide of the type used for lading straps. Such a material is low cost and adapted for the use and the new functions given to it in the present invention, because of its capacity to resist very high traction with almost no elongation. The use of a flat traction means ensures horizontal self-stability of the load, because the shape of the strip does not itself give rise to any tendency to rotation and prevents any twisting shock from being transmitted if a parasitic force is applied to the load. The combination of this flat strip with a winding system causing identical simultaneous elongation and shortening of the two runs of the strip, also gives vertical self-stability to the charge when it is not subjected to lateral slackening forces.

Figure 3:
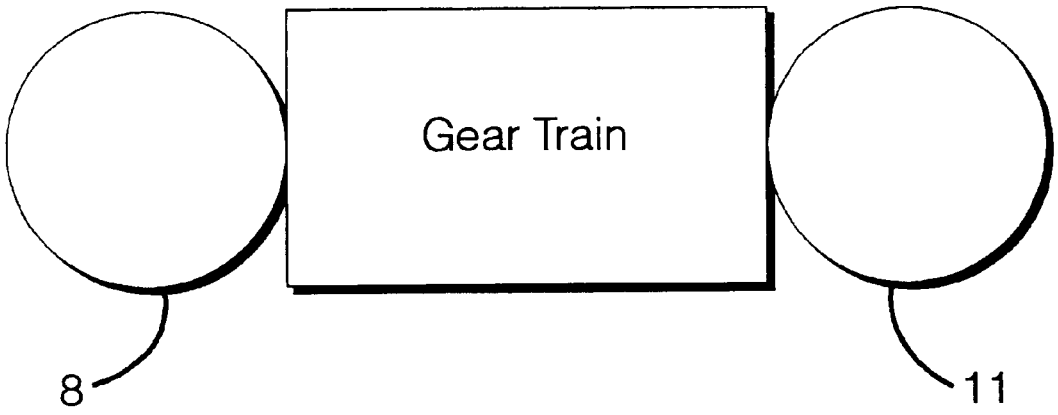
FIG. 3 shows schematically a gear train disposed between the motor gear and the drive gear.

In the illustrated example, the reel 4 engages directly by means of its gearing 11 shown partially, with the toothed gear 8 driven by the motor 7. The invention also encompasses the case of drive of the reel 4 by means of a gear train comprising one or several intermediate gears, as schematically shown in FIG. 3. The reel 4 could also be motor driven, which would permit eliminating the electric motor 7 and would provide a simple and economical mounting.

In the modification in which the strip 5 passes directly over the rollers 18, the automatic recentering of the attachment member 6 is ensured automatically by displacement along the strip 5, for example when the load point is not located exactly vertically with the lifting unit.

However, in the case of carriage 2 being displaceable to ensure automatic recentering along the vertical of the load, the attachment member 6 will remain motionless relative to the two runs of the strip and could be mounted fixedly on the strip by suitable attachment means (plate, screw, stitching, or the like).

The attachment member 6 can also be constituted directly by a connecting element connecting the two ends of the two runs of the strip 5. In this case, when the attachment member is fixedly mounted on the strip by any suitable attachment means, safety is ensured in case of breaking of one of the runs of the strip 5, because the load will remain suspended from the lifting apparatus by the remaining unbroken run.

This embodiment of lifting apparatus is of a simple and economical construction, because of the use of a single reel 4 and of the elimination of any adjustment of the mounting of the lifting unit.

The strip 5 in the form of a closed loop has two runs which roll up on the single reel. The frame 2 of the lifting unit carries a spacing roller 20 adapted to transmit equal traction force to the two rising runs 21, 22 of the strip 5. A spacing roller 20, in combination with a single reel 4 co-acts to impart stability to the load by the spacing which it gives to the two rising runs 21 and 22.

The two runs 21 and 22 are interconnected by the upper substantially horizontal run 23 of the strip 5.

The attachment member 6 is fixed so as to avoid the load falling in case of breaking of the runs of the strip, whilst maintaining the advantage of automatic realignment of the attachment member 6, because this attachment member 6 can move in a limited manner along the strip 5.

This limited movement results from the securement of an auxiliary strip 24 in the vicinity of the low point of the strip 5; this auxiliary strip 24 passes below a crosspiece 25 of the attachment member 6. This auxiliary strip 24 secured at its two ends to the strip 5 thus constitutes with the strip 5 a safety loop enclosing the attachment member 6 and maintaining it suspended to the remaining run in the case of breakage of the other run.

The lifting apparatus comprises control and supply means (not shown), preferably control and supply means of an electrical or electronic nature. These means, analogous to those which are used in conventional chain or cable lifting apparatus, do not require a more detailed description.

Figure 2:
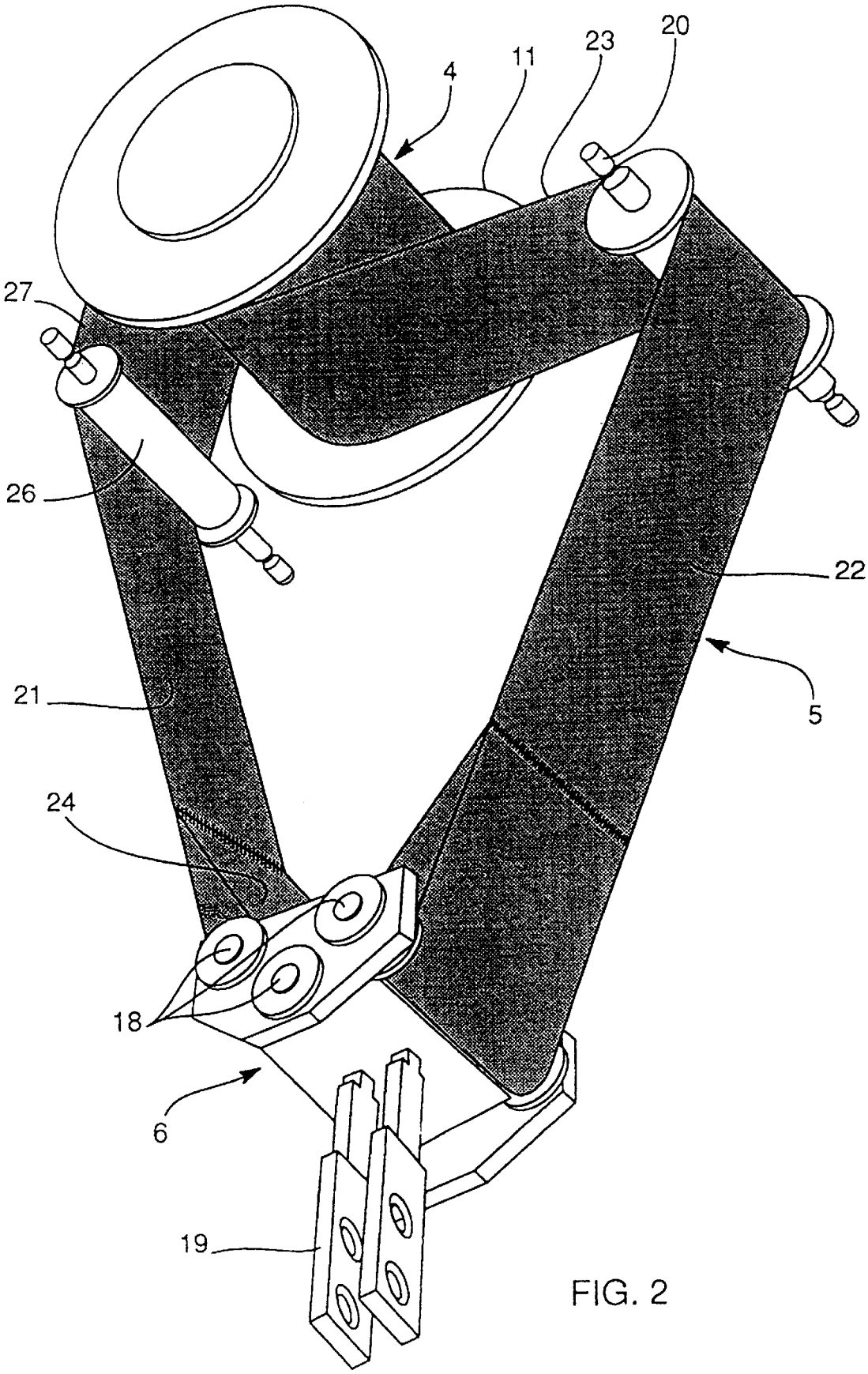
FIG. 2 shows schematically in fragmentary perspective view a second embodiment of lifting apparatus according to the invention.

With reference to FIG. 2, another embodiment of the invention comprises elements identical or functionally equivalent to those described in reference to FIG. 1 and denoted by the same reference numerals as those in FIG. 1.

This embodiment has a supplemental spacing roller 26 located substantially at the same height as the spacing roller 20, so as to increase the stability of the strip 5 and to ensure symmetric geometry between the two rollers 20 and 26 and the attachment member 6.

The two rising runs 21 and 22 are thus symmetrical and form the two sides of an isosceles trapezium defined by the axes of the rollers 20 and 26 and the axes of the two lateral rollers 18.

Because of the presence of the supplemental roller 26, a supplemental run 27 which is substantially vertical is formed in the strip 5 between the roller 26 and the reel 4.

The mounting of this subassembly takes place in an analogous manner on a frame similar to the frame described with reference to FIG. 1, it being noted that a complementary reception cradle must be provided for the axles of the roller 26 with cut-outs symmetrical to the cut-outs 20*a* of FIG. 1 serving to mount the roller 20 of FIG. 1. This provision of supplemental cut-outs on frame 2, in symmetrical position and in substantially the same plane as the cut-outs 20*a* of FIG. 1, presents no particular difficulty for those skilled in the art, and does not require a more detailed description.

What is claimed is:

1. In a lifting apparatus type, comprising a single reel and a flat strip (5) forming two hoist runs (21, 22), said two hoist runs (21, 22) being wound up together on said single reel (4) simultaneously during an operation of lifting a load; the improvement wherein the strip (5) comprises an auxiliary strip (24) forming a safety loop enclosing an attachment member (6) for a load, mounted on said strip (5), and the lifting apparatus comprises a spacing roller over which the strip passes to form a substantially horizontal upper run (23), thereby improving the stability of the load by spacing thus imparted to the two hoist runs (21, 22).

2. Lifting apparatus according to claim 1, wherein the strip (5) is constituted by a strap of braided polyamide.

3. Lifting apparatus according to claim 1, wherein the attachment member (6) is mounted to move freely on the strip (5).

4. Lifting apparatus according to claim 1, wherein the attachment member (6) is mounted fixedly on the strip (5).

5. Lifting apparatus according to claim 4, wherein the attachment member (6) is fixed to the lower ends of each upright run of the strip (5).

6. Lifting apparatus according to claim 1, wherein a gear train is disposed between a gear (8) of a drive motor for the apparatus (7) and a gear (11) on said single reel (4).

7. Lifting apparatus according to claim 1, wherein the strip (5) passes over a supplemental spacing roller (26) so as to increase the stability of the load.

8. Lifting apparatus according to claim 7, wherein said supplemental spacing roller (26) and the spacing roller (20) are mounted at substantially the same height and substantially symmetrically with respect to a direction of vertical movement of a load.

9. Lifting apparatus according to claim 7, wherein said supplemental spacing roller (26) forms in the strip (5) a substantially vertical run (27) that lines up on said single reel (4).

* * * * *